US011781197B2

(12) United States Patent
Lu et al.

(10) Patent No.: US 11,781,197 B2
(45) Date of Patent: Oct. 10, 2023

(54) STAMPED COMPONENTS WITH REDUCED HOT-FORMING CYCLE TIME

(71) Applicant: GM GLOBAL TECHNOLOGY OPERATIONS LLC, Detroit, MI (US)

(72) Inventors: Qi Lu, Shanghai (CN); Congjie Wang, Shanghai (CN); Jianfeng Wang, Jiangsu (CN); Zhisong Chai, Shanghai (CN); Wei Xu, Liaoning (CN)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 17/889,807

(22) Filed: Aug. 17, 2022

(65) Prior Publication Data

US 2023/0243012 A1 Aug. 3, 2023

(30) Foreign Application Priority Data

Jan. 28, 2022 (CN) ..... 202210106684.8

(51) Int. Cl.

| | |
|---|---|
| ***C21D 9/46*** | (2006.01) |
| ***C22C 38/18*** | (2006.01) |
| ***C22C 38/04*** | (2006.01) |
| ***C22C 38/02*** | (2006.01) |
| ***C21D 8/02*** | (2006.01) |
| ***C21D 6/00*** | (2006.01) |
| ***B21D 22/02*** | (2006.01) |

(52) U.S. Cl.

CPC ..... *C21D 9/46* (2013.01); *B21D 22/022* (2013.01); *C21D 6/002* (2013.01); *C21D 6/005* (2013.01); *C21D 6/008* (2013.01); *C21D 8/0205* (2013.01); *C21D 8/0247* (2013.01); *C22C 38/02* (2013.01); *C22C 38/04* (2013.01); *C22C 38/18* (2013.01); *C21D 2211/001* (2013.01); *C21D 2211/008* (2013.01)

(58) Field of Classification Search

None

See application file for complete search history.

(56) References Cited

U.S. PATENT DOCUMENTS

2021/0002746 A1* 1/2021 Lu ..... C22C 38/02

* cited by examiner

*Primary Examiner* — Anthony M Liang

(74) *Attorney, Agent, or Firm* — Quinn IP Law

(57) ABSTRACT

A method of forming a component includes providing a work-piece blank from a formable material. The work-piece blank includes at least one section having a surface roughness greater than 1 μm configured to facilitate efficient radiation of thermal energy therefrom when the work-piece blank is heated. The method also includes austenitizing the work-piece blank via heating the work-piece blank at a predetermined temperature for a predetermined amount of time to achieve an austenite microstructure in the at least one section and forestall oxidation of the work-piece blank. The method additionally includes transferring the austenitized work-piece blank into a forming press. The method also includes forming the component via the forming press from the austenitized work-piece blank. The method additionally includes quenching the component formed from the austenitized work-piece blank and cooling the formed component.

20 Claims, 3 Drawing Sheets

STAMPED COMPONENTS WITH REDUCED HOT-FORMING CYCLE TIME

CLAIM OF PRIORITY AND CROSS-REFERENCE TO RELATED APPLICATION

This application claims the benefit of Chinese Application Serial No. CN202210106684.8 filed Jan. 28, 2022, the entire content of which is incorporated by reference in its entirety.

INTRODUCTION

The present disclosure relates to stamped components with reduced hot-forming cycle time.

Stamping is a manufacturing process used for forming specifically shaped components from work-piece blanks. Stamping generally includes such forming operations as punching, blanking, embossing, bending, flanging, and coining. The stamping process typically employs a machine press to shape or cut the work-piece blank by deforming it with a die. Stamping of a work-piece into a desired shape is frequently limited by the ability of the work-piece to withstand deformation without developing splits and tears. Such concerns are further aggravated when the work-piece blank is generated from lower ductility materials, such as high-strength or press-hardened steels using a hot forming process.

Desired shape, strength, and stiffness of a stamped steel or other ferrous alloy component is generally facilitated by appropriate material microstructure. Requisite material microstructure and attendant strength and stiffness of the associated work-piece may be achieved via austenization heat treatment process. During austenitization the material is heated above its critical temperature long enough for transformation to austenite to take place. By changing the temperature for austenitization, the process may yield different and desired microstructures.

Generally, higher austenitization temperature produces a higher carbon content in austenite, whereas a lower temperature produces a more uniform structure. Carbon content in austenite is also a function of austenitization time. When an austenitized material is subsequently quenched, the material becomes hardened. Quenching is generally performed at a rate fast enough to transform austenite into martensite. As a result, the amount of time the steel work-piece blank is soaked at austenitization temperature is the primary factor in the heat treatment process cycle time and is also directly correlative to oxidation of the work-piece blank.

SUMMARY

A method of forming a component includes providing a work-piece blank from a formable material. The work-piece blank includes at least one section having a surface roughness greater than 1 μm configured to facilitate efficient radiation of thermal energy therefrom when the work-piece blank is heated. The method also includes austenitizing the work-piece blank via heating the work-piece blank at a predetermined temperature for a predetermined amount of time to achieve an austenite microstructure in the at least one section and forestall oxidation of the work-piece blank. The method additionally includes transferring the austenitized work-piece blank into a forming press. The method also includes forming the component via the forming press from the austenitized work-piece blank. The method additionally includes quenching the component formed from the austenitized work-piece blank and cooling the formed component.

The formable material may be a press-hardening steel (PHS) having material chemistry configured to facilitate effective oxidation resistance during the austenitizing and including, by weight, carbon (C) content at 0.05-0.45%, manganese (Mn) content at 0-4.5%, chromium (Cr) content at 0.5-6%, and silicon (Si) content at 0.5-2.5%.

The work-piece blank may be characterized by an absence of antioxidation coating.

For the at least one section having a thickness in a range of 1.0-2.0 mm, the predetermined amount of time to achieve the austenite microstructure in the subject section may be in a range of 2-8 minutes. For the at least one section having a thickness in a range of 2.0-3.5 mm, the predetermined amount of time to achieve the austenite microstructure may be in a range of 4-12 minutes.

The predetermined temperature may be in a range of 880-950° C.

The subject section of the work-piece blank having surface roughness greater than 1 μm may be characterized by an eco-pickled surface, such as via steel grit or silicon carbide (SiC).

The subject section of the work-piece blank having surface roughness greater than 1 μm may also be characterized by a sandblasted surface or a shotblasted surface.

The work-piece blank may be either a tailor-welded or a tailor-rolled blank and include the at least one section having the surface roughness greater than 1 μm and another section having a surface roughness smaller than 1 μm. The section having the surface roughness greater than 1 μm may have a thickness comparatively greater than the section having the surface roughness smaller than 1 μm to thereby facilitate homogenous heating of the work-piece blank during the austenitizing.

The surface roughness of the subject at least one section of the work-piece blank may be in a range of 1-2 μm or in a range 2-3 μm.

The component formed from the austenitized work-piece blank may have a microstructure including martensite+austenite at greater than 95% by volume and ferrite at less than 5% by volume.

Austenitizing of the work-piece blank may be accomplished via radiation heating in a furnace.

The component may be an automotive vehicle body structural element such as an A-pilar or a B-pillar.

The above features and advantages, and other features and advantages of the present disclosure, will be readily apparent from the following detailed description of the embodiment(s) and best mode(s) for carrying out the described disclosure when taken in connection with the accompanying drawings and appended claims.

DETAILED DESCRIPTION

Figure 1:
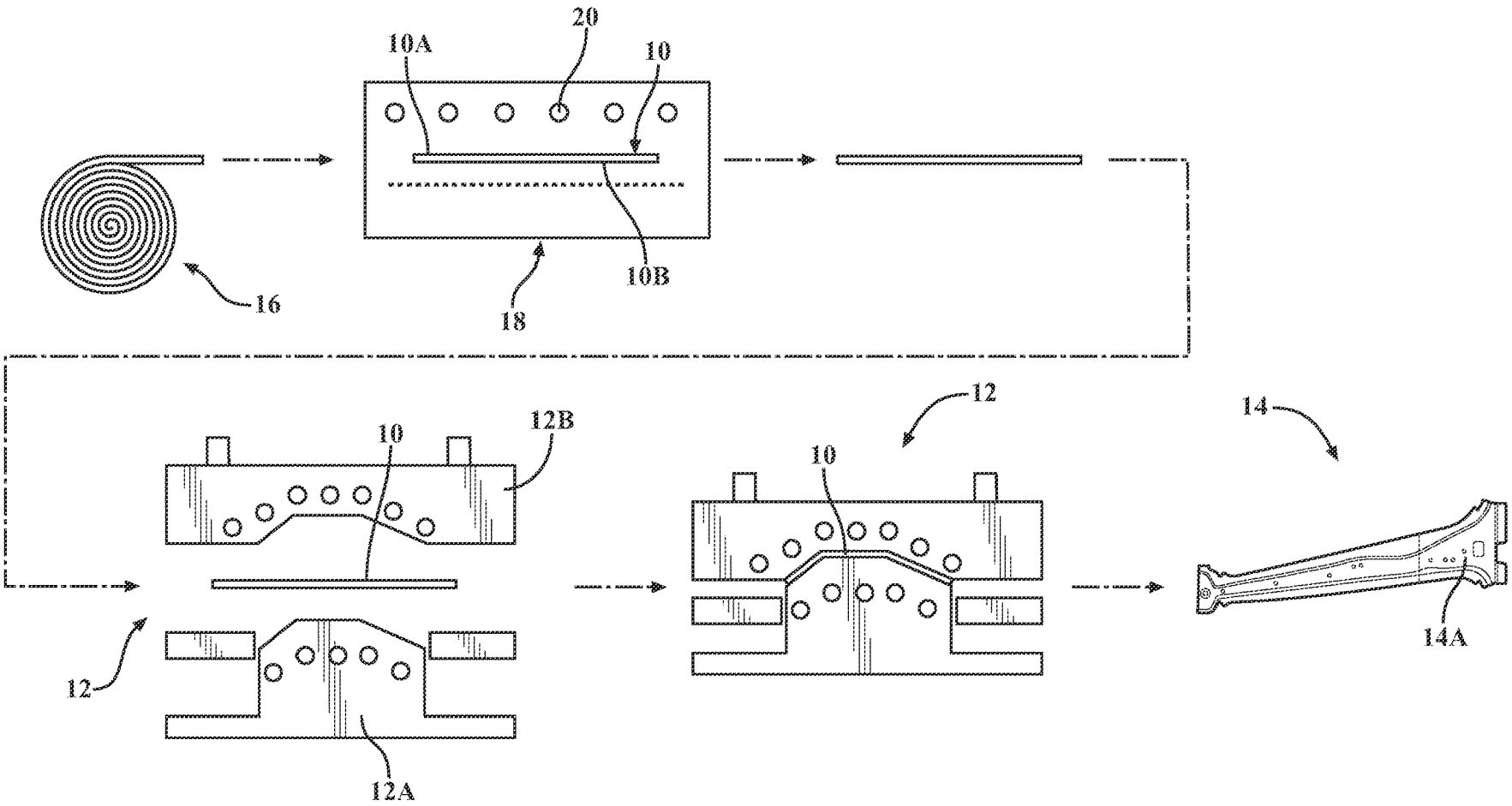
FIG. 1 is a schematic perspective illustration of a hot-forming process including austenitization and forming in a press to generate a component from a work-piece blank having at least one section with high surface roughness for reduced cycle time and material oxidation during heating, according to the disclosure.

Referring to the drawings in which like elements are identified with identical numerals throughout, FIG. 1 illustrates, in detail, processing and forming, such as stamping, of a work-piece blank 10. Such work-piece blanks 10 are frequently used in manufacturing processes, such as metal stamping, to form specifically shaped high strength components. Typically, such components are formed from work-piece blanks 10 in a forming or stamping press 12 using stamping tooling such as a die 12A and a punch 12B, as shown in FIG. 1. Each work-piece blank 10 is typically a pre-cut piece of formable material, for example sheet metal, such as cold rolled steel.

Specifically, the formable material may be a press-hardened steel (PHS) selected for the subject work-piece blank 10 used in manufacture of a structural component 14. The structural component 14 may, for example, be an automotive body pillar, such as a vehicle B-pillar shown in FIGS. 1 and 3 or an A-pillar (not shown). PHS is a high-strength steel typically delivered in rolls or coils of various sizes for blanking, austenitizing, and additional processing. Generally, austenitization and quenching is a hardening process used on iron-based metals to promote better mechanical properties of the material. The purpose of austenitizing steel and other ferrous alloys is to soften the materials and form them into the required shape and the purpose of quenching is to provide strength and resistance to the material. The temperature at which steel and other ferrous alloys are heated above their critical temperatures is called the austenitizing temperature. The austenitizing temperature range varies for different grades of carbon, alloys, and tool steels.

After the metal is heated into the austenite region, it is then quenched in a heat extraction medium. For a hot forming process, the steel is quenched directly to a temperature below 200° C. The desired microstructure is martensite (>90%) with some retained austenite (<10%). Once the austenitizing temperature is attained, proper microstructure and full hardness of steel, such as the PHS, may be attained via further heat treatment processes. In as received state, PHS typically has a tensile strength of approximately 600 MPa. However, after forming and quenching the tensile strength of PHS typically increases into the 1400-1800 MPa range accompanied by a commensurate decrease in ductility. Press hardening, a.k.a., hot stamping or hot press forming, allows such steels to be formed into complex shapes not commonly possible with regular cold stamping operations. PHS permits structural components, such as an automotive vehicle body pillar, to maintain required strength while using a thinner gauge material.

To produce a stamped part, such as the structural component 14 having a desired final shape or contour 14A (shown in FIG. 1), the work-piece blank 10 is generally cut from a coil 16 of PHS described above to be subsequently austenitized and formed in the press 12. The hot forming process may be configured to initially austenitize the unformed work-piece blank 10 in a furnace 18 (shown in FIG. 1). Following austenitization, the work-piece blank 10 may be formed by the stamping press 12 in hot condition and quenched in the die to obtain the component 14 with required material properties.

Figure 2:
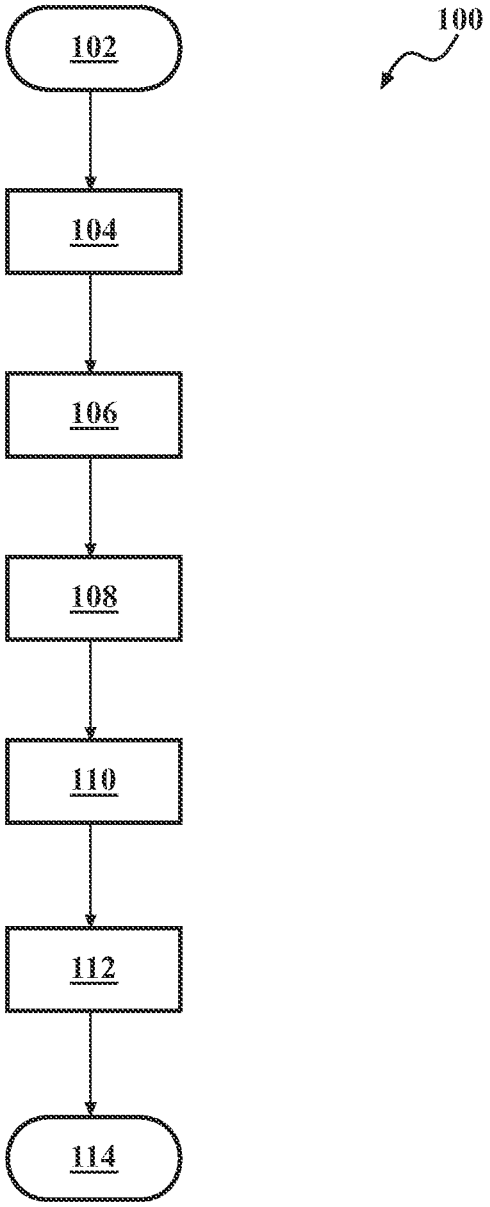
FIG. 2 is a flow chart illustrating a method of forming the component in the press from the austenitized work-piece blank shown in FIG. 1.
Figure 3:
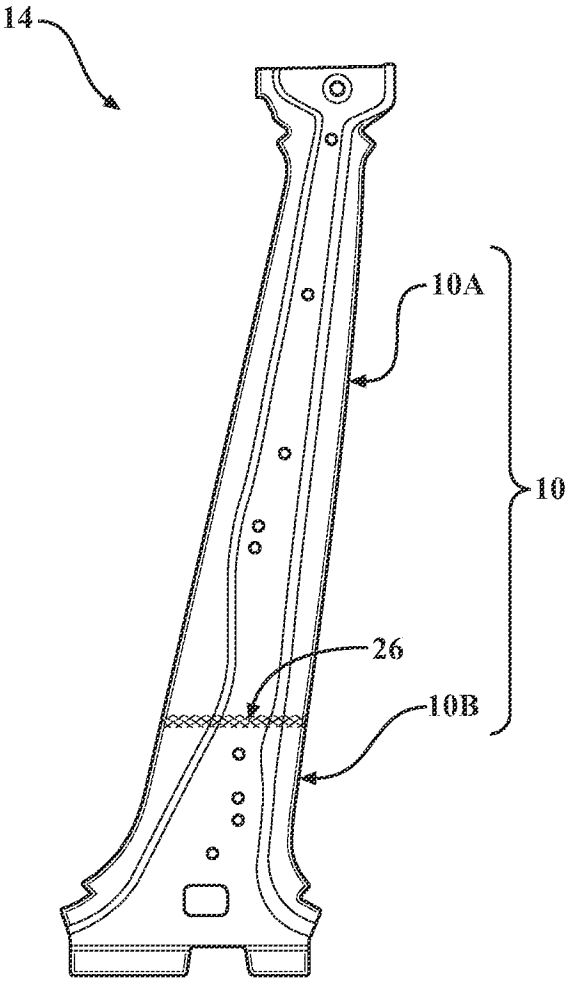
FIG. 3 is a schematic close-up illustration of an embodiment of the component formed from the work-piece blank having a high surface roughness section and a low surface roughness section, according to the disclosure.

FIG. 2 depicts a method 100 of forming the component 14 from the work-piece blank 10 using the stamping press 12 shown in and described above with respect to FIG. 1. The component 14 may specifically be an automotive vehicle body pillar, such as the B-pillar shown in FIG. 1. The forming of the component 14 is initiated in frame 102 with providing the work-piece blank 10 from a formable material, such as the PHS. As described above, the work-piece blank 10 may be cut out or blanked from a roll or coil of the subject material. As shown in FIG. 3. the work-piece blank 10 includes at least one section 10A having a surface roughness greater than 1 μm. More specifically, the surface roughness of the section 10A may be in a range of 1-2 μm or in a range of 2-3 μm, which is significantly greater than the approximately 0.8 μm roughness of bare PHS normally used for hot-forming of components in the press. For the remainder of the disclosure, the section 10A of the work-piece blank 10 will be referred to as having "increased surface roughness".

The increased surface roughness for the section 10A is selected as a result of experimentation which has shown that the heating rate of PHS, such as during austenitization, is significantly enhanced by the increased surface roughness due to improved thermal energy retention. The increased heating rate reduces the hot-forming cycle time and decreases probability of or forestalls oxidation of the material due to the reduced amount of time at high temperature. Hence, the subject increased surface roughness of the section 10A is specifically configured to facilitate efficient radiation of thermal energy therefrom, i.e., enhance or maximize radiation of thermal energy (as compared to the rate of energy radiation with a lower surface roughness), when the work-piece blank 10 is heated. Accordingly, in frame 102, the method may include generating the at least one section 10A on the PHS work-piece blank 10.

The subject increased surface roughness of the section 10A may be achieved by an eco-pickling process, for example, via steel grit or silicon carbide (SiC), i.e., the work-piece blank 10 may be characterized by an eco-pickled surface in the subject section. The increased surface roughness of the section 10A may also be achieved by a sandblasting or a shotblasting process, such that the work-piece blank 10 may be characterized by a respective sandblasted or shotblasted surface in the subject section. Additionally, PHS used for the work-piece blank 10 may have material chemistry specifically configured to facilitate effective oxidation resistance during austenitizing. For example, the PHS may have, by weight, carbon (C) content at 0.05-0.45%, manganese (Mn) content at 0-4.5%, chromium (Cr) content at 0.5-6%, and silicon (Si) content at 0.5-2.5%. Selection of the above PHS chemistry may then permit the work-piece blank 10 to be characterized by an absence, i.e., be devoid, of an antioxidation or oxidation resistant coating, such as a specially applied chemical or treatment designed to inhibit corrosion or oxidation of a metal by preventing oxygen from interacting therewith.

Figure 4:
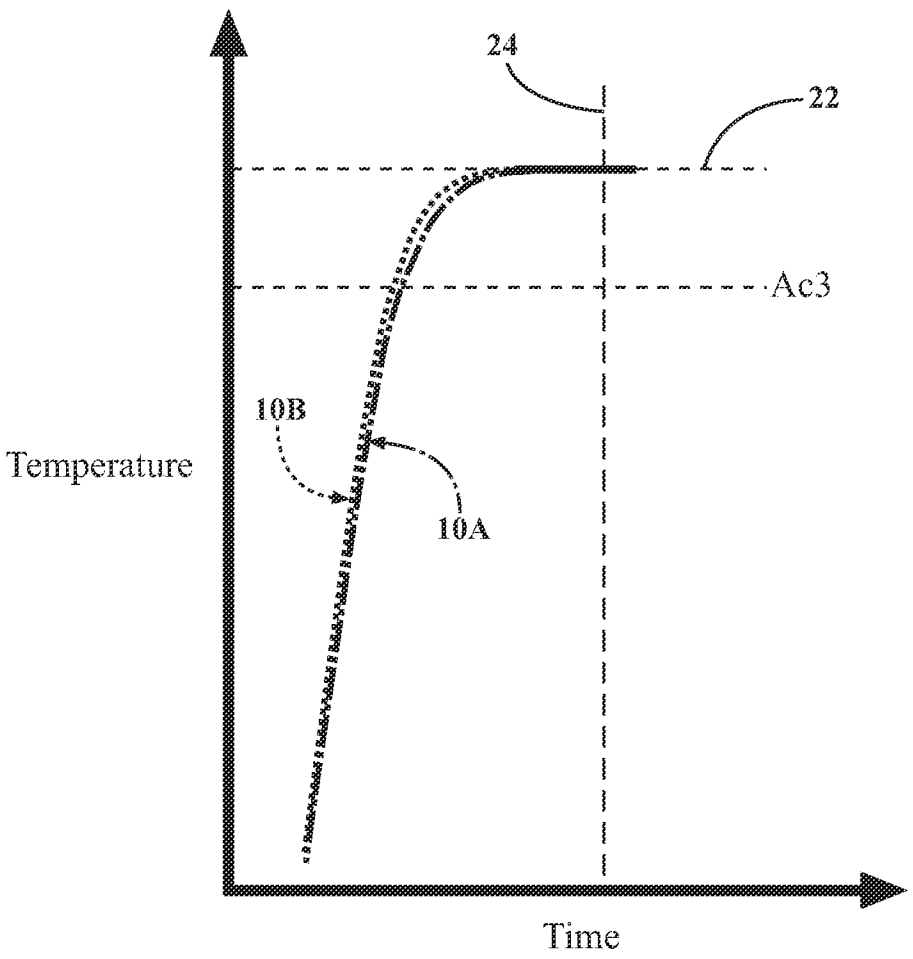
FIG. 4 is a data plot depicting heating temperature versus time for the component formed from the work-piece blank having the high surface roughness section and the low surface roughness section shown in FIG. 3, according to the disclosure.

Following frame 102, the method proceeds to frame 104. In frame 104 the method includes austenitizing the work-piece blank 10 via heating the work-piece blank at a predetermined austenitization temperature 22, above temperature Ac3 for a predetermined amount of time 24 (shown in FIG. 4) to achieve an austenite microstructure in the at least one section 10A. The subject increased surface roughness of the section 10A permits the austenite microstructure to be achieved at an increased heating rate, thereby minimizing oxidation of the work-piece blank 10. The predetermined austenitization temperature 22 may be in a range of 880-950° C. The section 10A of the work-piece blank 10 may have a thickness in a range of 1.0-2.0 mm, and in such an embodiment the predetermined amount of time 24 may be in a range of 2-8 minutes. Alternatively, if the section 10A has a thickness in a range of 2.0-3.5 mm, the predetermined amount of time 24 may be in a range of 4-12 minutes.

The work-piece blank 10 may be a tailored blank, specifically either tailor-welded or tailor-rolled in an area 26 shown in FIG. 3. Generally, tailored blanks are semi-finished parts made from joined sheets of different alloys, thicknesses, coatings, or material properties. After joining, tailored blanks are subjected to additional forming, such as deep drawing or stamping. Tailored blanks are frequently used to make items such as vehicle A-pillars and B-pillars, which are thicker near the hinges and thinner in other areas to withstand different types of loads. In the embodiment of the tailored work-piece blank 10, the blank may include the section 10A having the surface roughness greater than 1 μm and additionally another section 10B (shown in FIG. 3) joined in the area 26. Section 10B is specifically intended to have a surface roughness smaller than 1 μm. Furthermore, the section 10A may have a thickness comparatively greater than the section 10B to thereby facilitate homogenous or uniform heating of the work-piece blank 10 during the austenitizing process, as shown in the heating temperature versus data plot of FIG. 4.

As shown in FIG. 1, austenitizing of the work-piece blank 10 may be achieved via radiation heating, specifically by placing the work-piece blank directly into the furnace 18. Alternatively, prior to being placed in the furnace 18, the work-piece blank 10 may be preheated via a heating mechanism 20. The heating mechanism 20 may include induction coils (not shown) configured to encircle the work-piece blank 10 in a predetermined plane, but without physically contacting the work-piece blank. In a separate embodiment, the heating mechanism 20 may employ direct current heating via physical contact of a heating element with the work-piece blank 10. The induction coil or direct current heating may therefore be used to preheat the work-piece blank 10, and the furnace 18 will then be used for homogenization of the temperature throughout the work-piece blank.

After austenitizing the work-piece blank 10, the method proceeds to frame 106. In frame 106 the method includes transferring the austenitized work-piece blank 10, e.g., from the furnace 18, into the forming press 12. Following frame 106, the method moves on to frame 108, where the method includes forming the component 14 via the forming press 12 from the austenitized work-piece blank 10. After frame 108, the method proceeds to frame 110. In frame 110 the method includes quenching the component 14 formed from the austenitized work-piece blank 10, such as in a salt bath. Following quenching of the component 14 in frame 110, the method moves on to frame 112. In frame 112 the method includes cooling the component 14 thus formed from the austenitized work-piece blank 10. Thus formed, the PHS component 14 microstructure is martensite+austenite at greater than 95% by volume and ferrite at less than 5% by volume. Following frame 112, the method may proceed to and conclude in frame 114 with trimming excess material, washing, and/or packaging the final component 14.

Generally, the above-disclosed method applied to the PHS work-piece blank 10 characterized by a higher surface roughness is intended to reduce austenitizing time by increasing heat transfer rate in the furnace 18. The reduced heating time will further improve the surface quality of the PHS work-piece blank 10 by forestalling oxidation and permitting the PHS work-piece blank to be employed without an anti-oxidation coating. The improved surface quality of the PHS work-piece blank 10 will enhance weldability of the work-piece blank and promote E-coat adhesion to its surface. Additionally, reduced heating time will decrease the overall cycle time of PHS hot-forming process and thus reduce the cost of the finished component 14.

The detailed description and the drawings or figures are supportive and descriptive of the disclosure, but the scope of the disclosure is defined solely by the claims. While some of the best modes and other embodiments for carrying out the claimed disclosure have been described in detail, various alternative designs and embodiments exist for practicing the disclosure defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

What is claimed is:

1. A method of forming a component, the method comprising:

providing a work-piece blank from a formable material, wherein the work-piece blank includes at least one section having a surface roughness greater than 1 μm configured to facilitate radiation of thermal energy therefrom when the work-piece blank is heated;

austenitizing the work-piece blank via heating the work-piece blank at a predetermined temperature for a predetermined amount of time to achieve an austenite microstructure in the at least one section and forestall oxidation of the work-piece blank;

transferring the austenitized work-piece blank into a forming press;

forming the component via the forming press from the austenitized work-piece blank;

quenching the component formed from the austenitized work-piece blank; and cooling the component formed from the austenitized work-piece blank.

2. The method of forming the component of claim 1, wherein the formable material is a press-hardening steel (PHS) having material chemistry configured to facilitate oxidation resistance during the austenitizing and including, by weight, carbon (C) content at 0.05-0.45%, manganese (Mn) content at 0-4.5%, chromium (Cr) content at 0.5-6%, and silicon (Si) content at 0.5-2.5%.

3. The method of forming the component of claim 1, wherein the work-piece blank is characterized by an absence of antioxidation coating.

4. The method of forming the component of claim 1, wherein the at least one section has a thickness in a range of 1.0-2.0 mm and the predetermined amount of time is in a range of 2-8 minutes, or wherein the at least one section has a thickness in a range of 2.0-3.5 mm and the predetermined amount of time is in a range of 4-12 minutes.

5. The method of forming the component of claim 1, wherein the predetermined temperature is in a range of 880-950° C.

6. The method of forming the component of claim 1, wherein the at least one section of the work-piece blank is characterized by one of an eco-pickled surface, a sandblasted surface, and a shotblasted surface.

7. The method of forming the component of claim 1, wherein:

the work-piece blank is one of a tailor-welded and a tailor-rolled blank and includes the at least one section having the surface roughness greater than 1 μm and another section having a surface roughness smaller than 1 μm; and the section having the surface roughness greater than 1 μm has a thickness comparatively greater than the section having the surface roughness smaller than 1 μm to thereby facilitate homogenous heating of the work-piece blank during the austenitizing.

8. The method of forming the component of claim 1, wherein the surface roughness of the at least one section of the work-piece blank is in a range of 1-2 μm or 2-3 μm.

9. The method of forming the component of claim 1, wherein the component formed from the austenitized work-piece blank has a microstructure including martensite+ austenite at greater than 95% by volume and ferrite at less than 5% by volume.

10. A method of hot-forming a component from a press-hardening steel (PHS) work-piece blank, the method comprising:

generating on the PHS work-piece blank at least one section having a surface roughness greater than 1 μm, wherein the surface roughness of at least one section is configured to facilitate radiation of thermal energy therefrom when the work-piece blank is heated;

austenitizing the PHS work-piece blank via heating the PHS work-piece blank at a predetermined temperature for a predetermined amount of time to achieve an austenite microstructure in the at least one section and forestall oxidation of the work-piece blank;

transferring the austenitized PHS work-piece blank into a forming press;

forming the component via the forming press from the austenitized PHS work-piece blank;

quenching the component formed from the austenitized PHS work-piece blank; and cooling the component formed from the austenitized PHS work-piece blank.

11. The method of hot-forming the component from the PHS work-piece blank of claim 10, wherein chemistry of the PHS work-piece is configured to facilitate oxidation resistance during the austenitizing and includes, by weight, carbon (C) content at 0.05-0.45%, manganese (Mn) content at 0-4.5%, chromium (Cr) content at 0.5-6%, and silicon (Si) content at 0.5-2.5%.

12. The method of hot-forming the component from the PHS work-piece blank of claim 10, wherein the PHS work-piece blank is characterized by an absence of antioxidation coating.

13. The method of hot-forming the component from the PHS work-piece blank of claim 10, wherein the at least one section has a thickness in a range of 1.0-2.0 mm and the predetermined amount of time is in a range of 2-8 minutes, or wherein the at least one section has a thickness in a range of 2.0-3.5 mm and the predetermined amount of time is in a range of 4-12 minutes.

14. The method of hot-forming the component from the PHS work-piece blank of claim 10, wherein the predetermined temperature is in a range of 880-950° C.

15. The method of hot-forming the component from the PHS work-piece blank of claim 10, wherein generating the at least one section having a surface roughness greater than 1 μm includes eco-pickling, sandblasting, or shotblasting the at least one section.

16. The method of hot-forming the component from the PHS work-piece blank of claim 10, wherein:

the PHS work-piece blank is one of a tailor-welded and a tailor-rolled blank and includes the at least one section having the surface roughness greater than 1 μm and another section having a surface roughness smaller than 1 μm, and the section having the surface roughness greater than 1 μm has a thickness comparatively greater than the section having the surface roughness smaller than 1 μm to thereby facilitate homogenous heating of the PHS work-piece blank during the austenitizing.

17. The method of hot-forming the component from the PHS work-piece blank of claim 10, wherein the surface roughness of the at least one section of the PHS work-piece blank is in a range of 1-2 μm or 2-3 μm.

18. A method of hot-forming an automotive vehicle body pillar from a press-hardening steel (PHS) work-piece blank, the method comprising:

generating on the PHS work-piece blank at least one section having a surface roughness in a range of 1-2 μm or 2-3 μm, wherein the surface roughness of the at least one section is configured to facilitate radiation of thermal energy therefrom when the work-piece blank is heated;

austenitizing the work-piece blank in a furnace via heating the work-piece blank at a predetermined temperature for a predetermined amount of time to achieve an austenite microstructure in the at least one section and forestall oxidation of the work-piece blank;

transferring the austenitized work-piece blank from the furnace to a forming press;

forming the body pillar via the forming press from the austenitized work-piece blank;

quenching the body pillar formed from the austenitized work-piece blank; and cooling the body pillar formed from the austenitized work-piece blank.

19. The method of hot-forming the automotive vehicle body pillar from the PHS work-piece blank of claim 18, wherein chemistry of the PHS work-piece is configured to facilitate oxidation resistance during the austenitizing and includes, by weight, carbon (C) content at 0.05-0.45%, manganese (Mn) content at 0-4.5%, chromium (Cr) content at 0.5-6%, and silicon (Si) content at 0.5-2.5%.

20. The method of hot-forming the automotive vehicle body pillar from the PHS work-piece blank of claim 18, wherein the body pillar formed from the austenitized work-piece blank has a microstructure including martensite+ austenite at greater than 95% by volume and ferrite at less than 5% by volume.

* * * * *